US008226820B1

(12) United States Patent
Wegner

(10) Patent No.: US 8,226,820 B1
(45) Date of Patent: Jul. 24, 2012

(54) HANDLING AND EXTRACTING HYDROCARBONS FROM TAR SANDS

(76) Inventor: Paul C. Wegner, San Carlos, CA (US)

( * ) Notice: Subject to any disclaimer, the term of this patent is extended or adjusted under 35 U.S.C. 154(b) by 473 days.

(21) Appl. No.: 12/490,782

(22) Filed: Jun. 24, 2009

Related U.S. Application Data

(60) Provisional application No. 61/132,862, filed on Jun. 24, 2008.

(51) Int. Cl.
*C10G 1/04* (2006.01)

(52) U.S. Cl. ..... 208/390

(58) Field of Classification Search ..... 208/390; 422/255, 256, 261, 280–281
See application file for complete search history.

(56) References Cited

U.S. PATENT DOCUMENTS

| | | | |
|---|---|---|---|
| 2,965,557 | A | 12/1960 | Price |
| 3,553,098 | A | 1/1971 | Claridge et al. |
| 4,120,775 | A | 10/1978 | Murray et al. |
| 4,539,098 | A | 9/1985 | Yudovich |
| 4,737,267 | A | 4/1988 | Pao et al. |
| 5,273,647 | A | 12/1993 | Tuszko et al. |
| 5,534,136 | A | 7/1996 | Rosenbloom |
| 5,772,127 | A | 6/1998 | Maciejewski et al. |
| 5,998,640 | A | 12/1999 | Haefele et al. |
| 6,004,455 | A | 12/1999 | Rendall |
| 2007/0131590 | A1 | 6/2007 | Bozak et al. |
| 2007/0205141 | A1 | 9/2007 | Freeman et al. |

FOREIGN PATENT DOCUMENTS

| | | |
|---|---|---|
| CA | 1188645 | 6/1985 |
| EP | 0050211 | 9/1981 |
| EP | 0081016 | 12/1981 |
| WO | WO9212896 | 7/1993 |
| WO | WO9730010 | 8/1997 |

OTHER PUBLICATIONS

Svarovsky, L. (1990). Solid-Liquid Separation, 3rd ed., Butterworths, 716 pgs.*
Cheremisinoff, N.P. (2000). Handbook of Chemical Processing Equipment. Elsevier, 535 pgs.

* cited by examiner

*Primary Examiner* — Walter D Griffin
*Assistant Examiner* — Brian McCaig
(74) *Attorney, Agent, or Firm* — Head Johnson & Kachigian P.C.

(57) ABSTRACT

A method and system for handling tar sands and extracting bitumen or oil from the tar sands. The method includes the steps of depositing tar sands in a hopper assembly with a first input auger. An organic solvent mixture is introduced to the tar sands in the hopper assembly and is dissolved by the organic solvent mixture. Sand and rocks from the tar sands is allowed to separate. The sands and liquid in a slurry of fluid are transported from the hopper assembly to a rinse chamber. The slurry of fluid is delivered into the top of the rinse chamber tangentially to cause cyclonic action of the slurry in the rinsing chamber. The cyclonic action and gravity draws the sand downward. Solvent mixed with hydrocarbons are drawn off from the top of the rinse chamber and recirculated in a closed loop process. A portion of the solvent and hydrocarbon liquid mixture is pumped to a separator system in order to separate the oil and bitumen from the solvent.

10 Claims, 6 Drawing Sheets

HANDLING AND EXTRACTING HYDROCARBONS FROM TAR SANDS

CROSS-REFERENCE OF RELATED APPLICATION

This application claims priority to U.S. Provisional Application No. 61/132,862, filed Jun. 24, 2008 and U.S. patent application Ser. No. 11/761,773, filed Jun. 12, 2007, now abandoned.

BACKGROUND OF THE INVENTION

1. Field of the Invention

The present invention is directed to a method and apparatus for handling tar sands and extracting bitumen or oil from tar sands in an economical and efficient continuous closed loop system.

2. Prior Art

Tar sands, sometimes known as oil sands or bituminous sands, are a combination of clay, sand, water and bitumen. Bitumen is a semisolid form of oil. It is known to mine tar sands to extract the bitumen, which is upgraded into synthetic crude or refined directly into petroleum products.

Tar sands deposits are found in over 70 countries throughout the world and represent as much as two-thirds of the world's reserves of oil.

In the processing of tar sands which contain oil-bearing bitumen, the oil-bearing sands must first be mined, the tar sand must be processed to recover the hydrocarbons and the sand must be cleaned sufficiently to alleviate environmental concerns upon disposal or proper placement back into the environment.

There are various known methods of extracting the bitumen or oil from the tar sands. In one known process, the tar sands are mined and hot water and caustic soda (NaOH) are added to the sand. The resulting slurry is piped to an extraction plant where it is agitated and the oil skimmed from the top.

In an alternate known cold flow process, oil is pumped out of the sands using progressive cavity pumps which lift oil along with sand. This process only works well where the oil or bitumen is fluid enough to pump. Additionally, the sand causes the pumps and other equipment to wear.

In a further alternate known cyclic steam stimulation process, a well is put through cycles of steam injection, soaking, and oil production. Oil or bitumen is thereby extracted. Haefele et al. (U.S. Pat. No. 5,998,640) discloses a solvent extraction method that utilizes pressure to assist in the extraction. By providing a pressure differential, oil free solids may be removed from an oil extraction chamber.

Rosenbloom (U.S. Pat. No. 5,534,136) discloses a tar sand oil extraction system with an initial receptacle 16 which delivers slurry to a separator 20. Occluded oil is then washed with solvent in a screw conveyor. The washed sand is introduced to a solvent recovery furnace to vaporize the solvent.

A large portion of the expense of tar sand processing is in materials handling. The material is sticky, and tough. Conveyors, augers, and crushers wear quickly when handling tar sand. Solvent extraction processes are usually considered to be energy intensive and solvent loss is often an issue. The extraction efficiencies are normally no greater than 85%. In addition, cold weather can shut down most operations.

In order for the extraction of tar sands to be an economical endeavor, the separation process should ideally require low energy, provide a simple material handling method, and recycle most of the chemicals added for processing.

The present invention addresses these issues and also addresses issues concerning energy recycling and solids handling.

Accordingly, it is a principal object and purpose of the present invention to provide a tar sands processing system that does not require high pressure vessels.

It is a further principal object and purpose of the present invention to utilize tar sands as a source of cooling for a solvent condenser.

It is a further object and purpose of the present invention to use an oil/solvent mixture to dissolve, transport and classify the tar sands.

It is a further object and purpose of the present invention to provide a tar sands processing system that recycles most of the solvent used in extraction.

It is a further object and purpose of the present invention to provide a continuous tar sands handling and extraction process at atmospheric pressure in a closed loop system.

SUMMARY OF THE INVENTION

The present invention is directed to a process and a system for handling and extracting hydrocarbon liquids from tar sands. Initially, the tar sands are deposited into a hopper assembly. The hopper assembly receives a source of an organic solvent liquid mixture on the incoming tar sands. The mixture dissolves the oil or bitumen in the tar sands.

The tar sand is introduced in the open, topped hopper with a first input auger. The resultant slurry passes through a perforated rotating drum. Particulates under a certain size and liquid slurry pass through the drum.

Solvent laden gas in the hopper assembly is drawn into ducts and removed and pumped to a chiller unit which assists in converting vaporized solvent to liquid.

The mixture of fine sand and liquid containing solvent and oil or bitumen is then transported from the base of the hopper assembly to a rinse chamber in a fluid slurry by force of a pump.

The slurry enters into a tangential cyclone port near the top of the rinse chamber. Centrifugal force will cause the sand to separate from the solvent.

Assisted by gravity, slurry liquid gathers at the center and top of the rinse chamber while the sand moves downward in the rinse chamber. The slurry liquid is drawn off and recirculated through a recirculation line.

A portion of the fine sand and solvent and hydrocarbon liquid mixture is drawn off and sent into a sand settler tank and silt settler tank to further remove small solid particles such as sand. The fluid which is free of sand is then pumped to heat exchangers. As the combination solvent and liquid hydrocarbons are heated, the solvent will vaporize before the oil or bitumen to be recovered. The resulting liquid hydrocarbons represent the recoverable, usable product.

The vaporized solvent will pass to the top of the heat exchangers to a vapor collection chamber where the vapors are directed to a condenser to condense the clean solvent vapors into liquid solvent. The liquid solvent is thereafter directed back to a solvent storage tank for clean solvent.

A portion of the solvent vapors may be directed through a port to the recirculation loop heat exchanger to provide indirect heat to the recirculation loop solvent oil mixture, while the balance is directed to the condenser.

A shaft assembly in the rinse chamber may include a motor or motors. The shaft assembly and motors rotate a first conical tray in a first direction against the series of stationary plows. Rotation of the first conical tray relative to the plows tends to lift the solvent saturated sand upward out of the bowl of the first tray above the fluid line so that the sand moves below to a second tray. The sand residing in the second tray is heated. The solvent will be vaporized and drawn off to a condenser.

The solvent free sand will fall by gravity to a rotary valve where it is permitted to pass to a cylindrical tube with a rotating auger therein. Steam and an inert gas may be introduced to heat the sand and drive off any remaining solvent vapors, resulting in clean sand.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention is directed to a method and apparatus for handling and extracting oil from tar sands. The tar sands material is initially gathered or excavated from a deposit in various ways which are known and are not a part of the invention. For example, the material may be peeled off the tar sand deposit and dumped directly into an oil extraction or hopper assembly as large chunks sized from approximately ¼ to 12 inches (¼" to 12").

Figure 1:
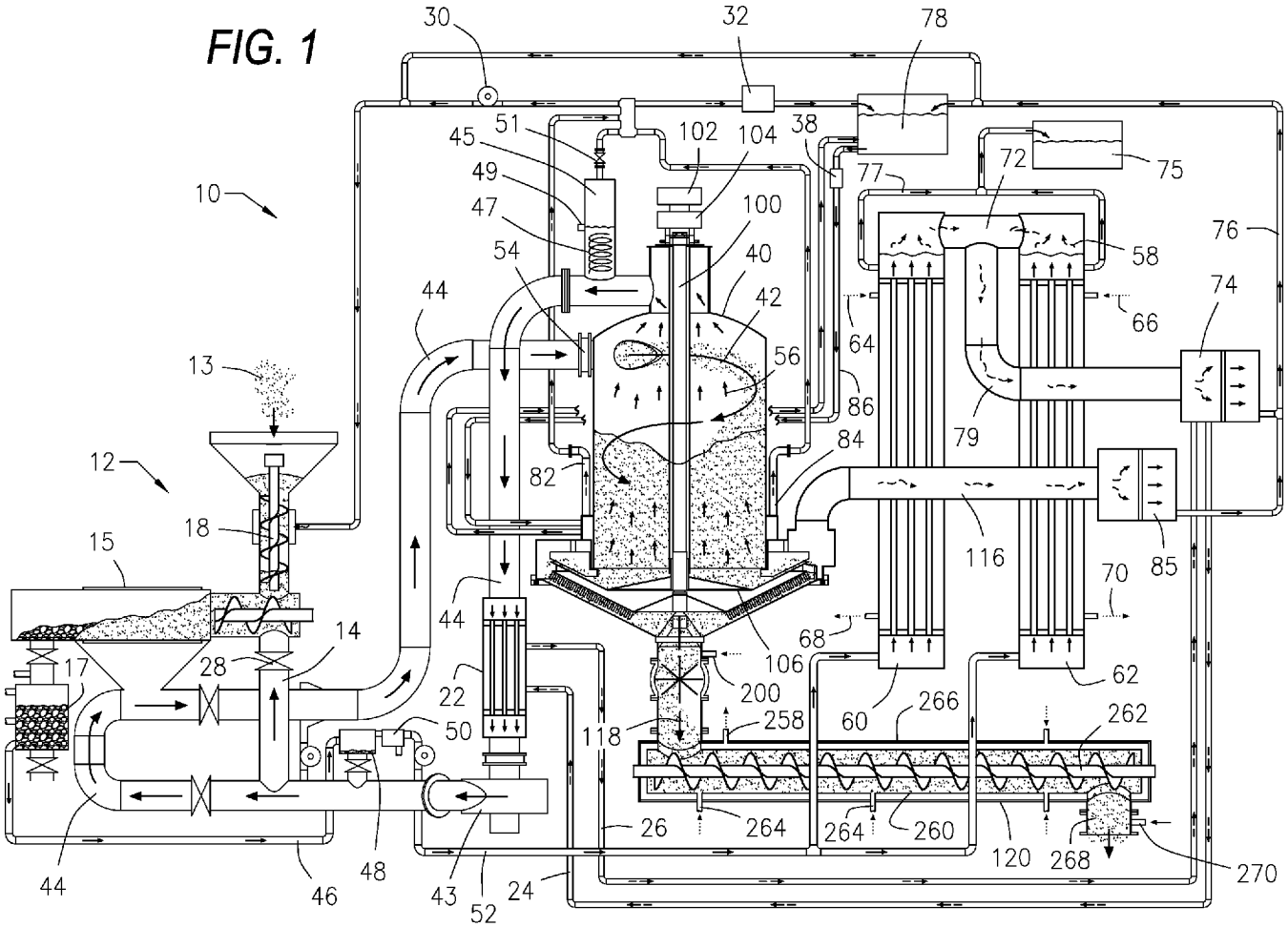
FIG. 1 is a simplified diagrammatic view of a system for handling and extracting hydrocarbons from tar sands constructed in accordance with the present invention.

Referring to the drawings in detail, FIG. 1 illustrates an over-all schematic diagram of a system 10 of handling and extracting hydrocarbons from tar sands. The system 10 may be located near a tar sands deposit so that transportation and handling costs are low. In one embodiment, the tar sands 13 are initially peeled off a deposit in sheets, such as one foot wide sheets. The tar sands material 13 is then dumped into an oil extraction hopper or dissolution assembly 12.

Figure 2:
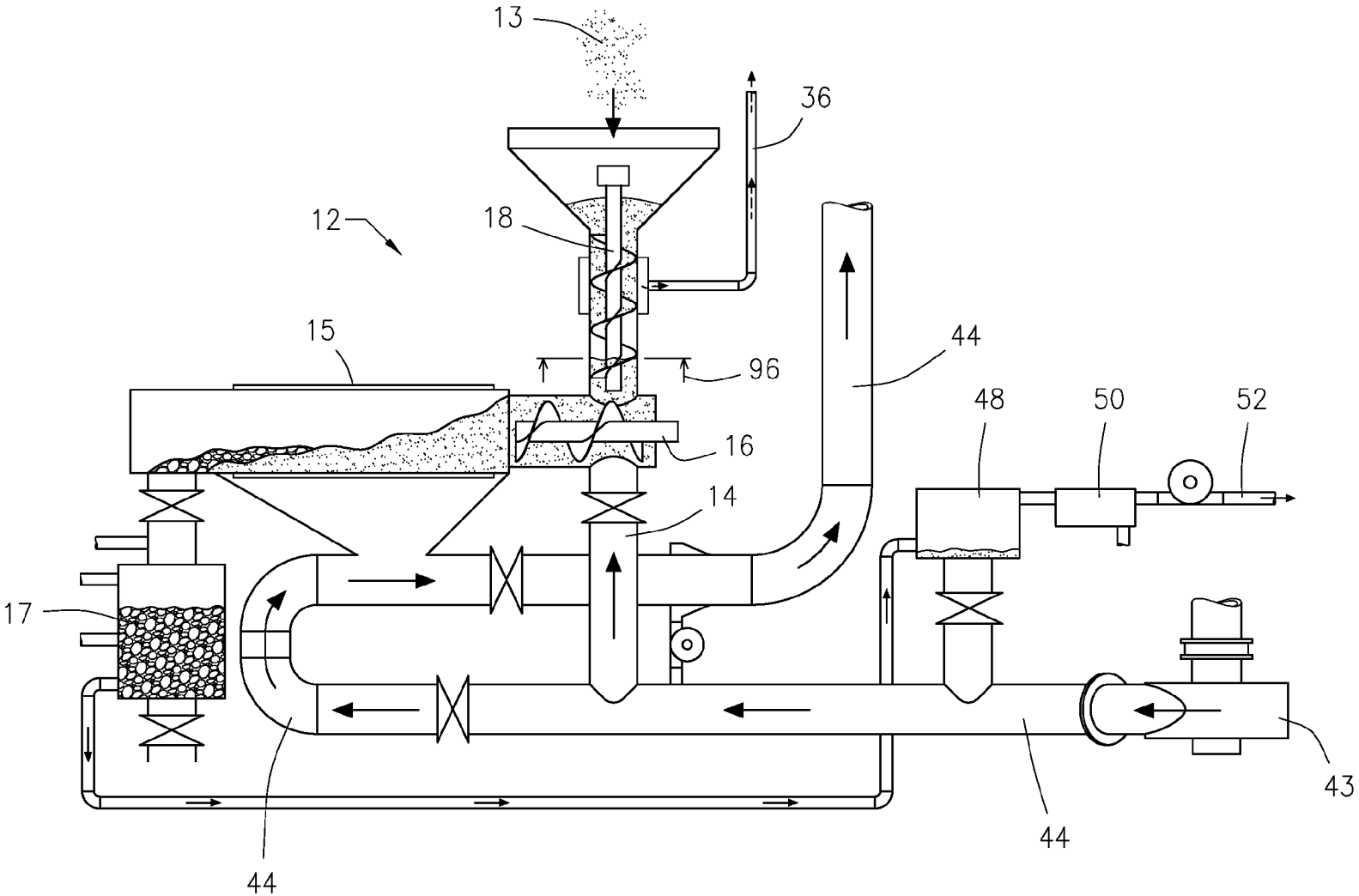
FIG. 2 is an enlarged view of a hopper assembly used as a part of the system shown in FIG. 1.

FIG. 2 illustrates an enlarged view of the hopper assembly 12. The hopper assembly 12 may be configured as with a conical open top and a cylindrical body cylinder. The tar sands 13 are delivered into the hopper assembly by a first input auger 18. The vertical input auger provides for uniform introduction and maintains a volume of tar sands in the hopper assembly 12.

The hopper assembly 12 may include a solvent supply line 14 which provides an organic solvent liquid mixture, such as a hexane or pentane. The solvent/bitumen mixture dissolves the oil or bitumen hydrocarbons in the tar sands. It will be appreciated that other solvents may be utilized within the spirit and scope of the present invention.

Solvent is introduced to the hopper assembly 12 from the incoming supply line 14 which branches off from a solvent recirculation loop 44 (to be described). The flow of solvent controls the rate and how well the nonporous rocks are washed.

A valve 28 modulates the flow of oil solvent which controls the rate of sand erosion, which in turn determines the rate of sand flowing into the recirculation loop 44. The level of solvent 96 is maintained as shown on FIG. 2.

Prior to entry into the hopper assembly 12, the solvent may be heated by being passed in heat exchange relationship in a solvent heat exchanger 22.

Solvent vapors and/or solvent are introduced into the heat exchanger 22 in heat exchange relationship as shown at line 24. Solvent vapor and condensate exit the heat exchanger 22 as shown at line 26 and will pass to a condenser to be described in detail.

Returning to a consideration of the hopper assembly 12, the heated solvent/bitumen mixture dissolves the oil or bitumen in the tar sands. The tar sands are then moved to a perforated rotating drum 15 by a second auger 16. The tumbling action caused by the rotating drum 15 helps break up the tar sands and beats the sand off of the rocks. The eroded sand below a certain size and the slurry mixture falls through the rotating drum to the bottom of the hopper assembly 12 and to the recirculation line 44.

The sand and rocks over a certain size move axially through the drum 15 and along with the slurry flow to a tramp box or rock basket 17 which retains the rocks. An entry and exit to the tramp box 17 may include valves to close off the tramp box in order to periodically remove rocks therein.

The incoming tar sands brought in by the auger 18 creates a seal in the hopper assembly 12. Solvent laden gas is drawn through a duct or ducts 36 from a gas pump 30 as exhaust from the solvent extraction process. The solvent vapors are delivered to a chiller or condenser unit 32 which assists in converting the vaporized solvent back into liquid. This may be followed by or combined with a gas scrubber unit. The resulting gas may be directed to a condenser 32. The liquid solvent from the condenser 32 may then be directed to a solvent storage tank 78 for reuse.

The hopper assembly 12 reduces or eliminates the need for a crusher and insures a high level of extraction. Surface oil is effectively removed from rocks in the tar sand. The present invention uses the oil/solvent mixture to wash the tar sands in lieu of a crusher. Since the flow solvent is functioning in lieu of the crushing agent, there is little to wear out in the present system.

This has several benefits. The oil/solvent mixture only dissolves oil/sand aggregates, while leaving the non oil bearing rocks essentially untouched. Moreover, the hot oil/solvent mixture heats up the tar sand to maximize the dissolution speed.

In many cases, the majority of the tar sand has a particle size of less than 1/16 of an inch. At this particle size, the washing of the oil and bitumen from the tar sand is rapid and efficient. The oil/solvent fine sand mixture provides an ideal mixture for easy transport of the mixture at the mining site to the wash chamber and desolventization chamber. The combination oil/solvent provides the proper amount of viscosity, lubrication, and density to facilitate the transport of the dissolved tar sand as slurry through a pipe. These features eliminate the crushing operation and expensive transport tar sand from the mining pit to the processing area.

The mixture of fine sand and liquid containing solvent and oil or bitumen is then transported through the recirculation line 44 from the base of the hopper assembly 12 to near a top of a rinse chamber 40 in a pipe as a fluid slurry through the recirculation line 44.

As will be described herein, the recirculation line 44 forms a continuous loop with the rinse chamber 40 to supply solvent and sand slurry and remove solvent and liquid hydrocarbon and is driven by a pump 43.

The slurry in the recirculation line 44 enters the rinse chamber through a tangential cyclone port 54 located near the top of the rinse chamber 40. Since only fine sand particles are allowed to enter, the slurry line transportation is simple and uniform. Since the slurry is pumped into the rinse chamber 40, centrifugal force will cause the sand to separate from the solvent as illustrated by arrows 42. Once the sand enters the rinse chamber 40, the cyclone action of the rinse chamber configuration allows most of the sand to be removed from the oil-solvent mixture before returning the oil-solvent mixture to the recirculation line 44 where it is recirculated back as previously described and is the motive power for the oil solvent sand mixture transport.

Since the sand is removed prior to returning to the recirculation pump 43, wear issues are minimized for the pump and spray nozzles.

The fluid slurry enters near the top of the rinse chamber 40 tangentially which causes a cyclonic action within the rinse chamber 40. Due to centrifugal force, slurry liquid gathers at the center of the rinse chamber 40 while the sand in the slurry moves toward the outer walls of the rinse chamber. In addition, the force of gravity causes the sand to move downward in the rinse chamber 40.

By the time the tar sands reach the rinse chamber 40, the vast majority of oil and/or bitumen is dissolved out of the tar sands. The remaining oil and/or bitumen are removed by displacement washing. The rinse chamber 40 configuration allows the oil and solvent mixture to be removed from the rinse chamber 40 on a continuous basis as a dirt or sand free oil and solvent mixture. This permits uniform processing conditions independently of pay dirt oil concentration.

Figure 3:
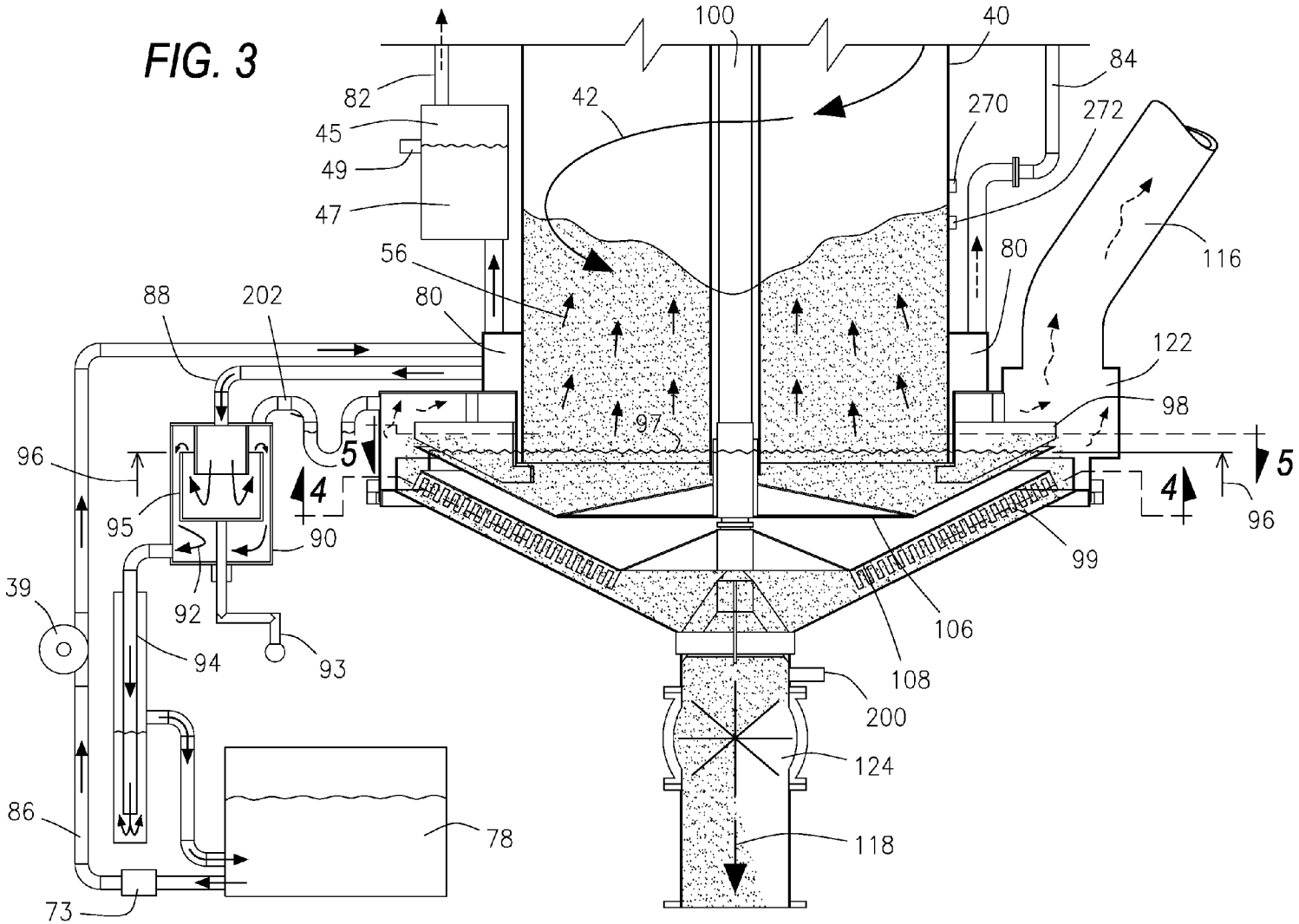
FIG. 3 is an enlarged view of a cyclone separator and rinse chamber used as a part of the system shown in FIG. 1.
Figure 4:
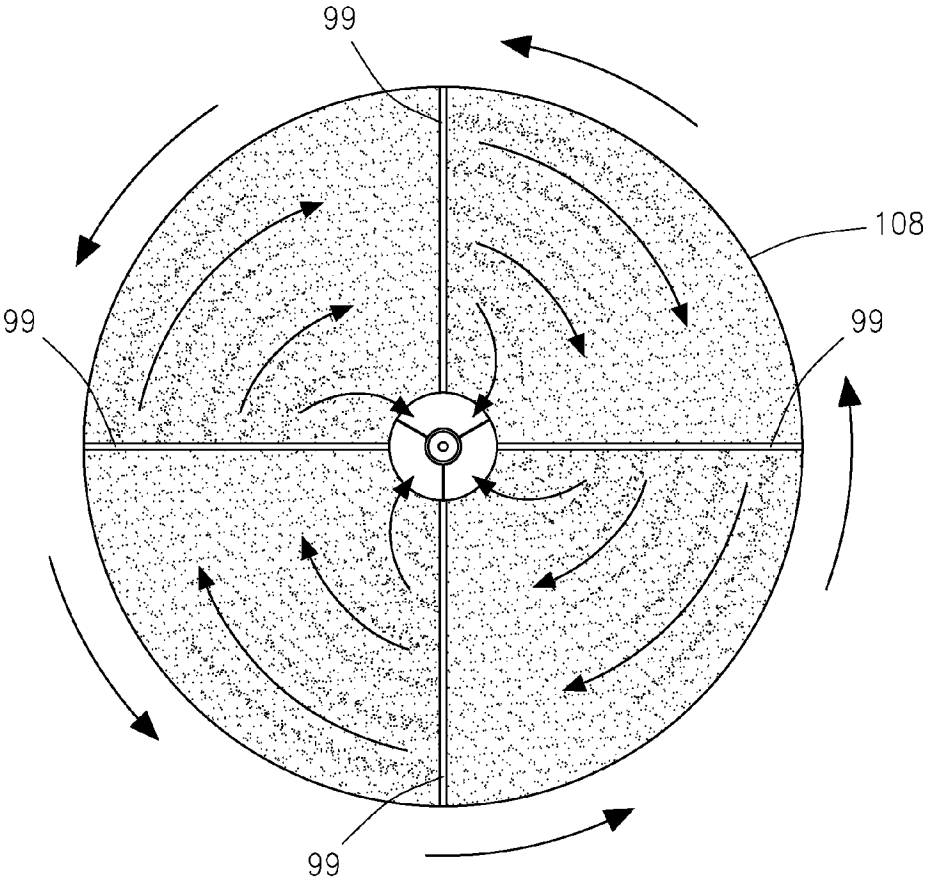
FIG. 4 is a sectional view taken along section line 4-4 of FIG. 3.

Referring to the enlarged view in FIG. 3 and with continued reference to FIG. 1, additional oil free solvent is also introduced at and pumped to the bottom of the rinse chamber 40 through a line 86. As the dissolved sand progresses downward through the rinse chamber 40, the solvent progresses up the rinse chamber in a counter current fashion as shown by arrows 56.

Solvent with liquid oil or bitumen is removed via the recirculation line 44 and moved by a pump 43 in a loop past the solvent supply line connection and past the connection with the hopper assembly 12.

As seen in FIGS. 1 and 2, a portion of the solvent and hydrocarbon liquid mixture is drawn off from the tramp box 17 via a line 46 to a sand settler tank 48. Sand is permitted to fall by gravity and return to the recirculation line 44. A silt settler tank 50 serves to further polish off or remove small solid particles, such as sand, and periodically removes clay and high molecular weight asphalt which may be used in asphalt applications.

The fluid which is free of sand is then pumped via a line 52 to two heat exchangers 60 and 62 arranged in parallel. Steam is circulated into the heat exchangers 60 and 62 in heat exchange relationship operating in parallel through inputs 64 and 66, respectively, and then out therefrom through outputs 68 and 70, respectively. It will be appreciated that one or more heat exchangers may be employed within the spirit and scope of the invention.

As the combination solvent and liquid hydrocarbons are heated in the heat exchangers 60 and 62, the solvent will vaporize before the oil or bitumen to be recovered or harvested. Accordingly, as shown by arrows 58, the vaporized solvent will pass to the top of the heat exchangers 60 and 62 to a vapor collection chamber 72. Thereafter, the vapors are passed through a duct or ducts 79 and directed to a condenser 74, which causes the solvent vapors to turn into solvent liquid. The excess liquid solvent in the heat exchangers is directed to the solvent storage tank 78.

A portion of the vapors in the condenser 74 are directed via line 24 to the recirculation heat exchangers 22. The liquid solvent gathered in the condenser 74 is thereafter directed via line 76 back to a solvent storage tank 78 for clean solvent for reuse.

At the same time, the liquid in the heat exchangers, which is primarily hydrocarbon oil and bitumen, is drawn off via liquid hydrocarbon lines 77 to a liquid hydrocarbon oil storage tank 75. The storage tank 75 contains the recoverable liquid hydrocarbons harvested from the system.

The interior of the rinse chamber 40 is kept at a pressure less than atmospheric pressure which eliminates any need for a depressurization chamber for removing desolventized sand from the process. This, in turn, permits continuous production of desolventized sand without interruption. Accordingly, the desolventization or rinse chamber 40 is kept at atmospheric pressure or less to prevent solvent vapors from leaving the desolventized sand exit port.

Turning to a consideration of FIG. 2 which shows a portion of the rinse chamber 40, and continuing consideration of the system 10 in FIG. 1, an annular siphon chamber 80 is provided surrounding the rinse chamber 40 and is in fluid communication therewith. In the preferred embodiment shown, the siphon chamber 80 substantially circumnavigates the rinse chamber 40. The siphon chamber 80 is connected via a line or lines 82 and 84 to the gas pump 30 (not shown in FIG. 2) which insures that a vacuum will be provided to the siphon chamber 80.

Liquid solvent is provided from the solvent storage tank 78 via the line 86 to the siphon chamber 80 by action of a pump 39. An air or water cooled heat exchanger 73 may be provided.

At the same time, liquid solvent is allowed to travel from the rinse chamber via line 88 to an excess solvent chamber 90 wherein solvent is allowed to pass as shown by arrows 92 into an inner container 95 having an open top. Once the solvent exceeds the level of the open top, the solvent travels via line 94 to the liquid solvent storage tank 78. The level of the open top of the inner container 95 is adjustable by a handle 93. A threaded screw or other arrangement is possible within the spirit and scope of the invention. The solvent level 97 in the rinse chamber 40 and the solvent level in the excess solvent chamber 90 is maintained at the same level as shown by arrows 96.

The solvent level in the rinse chamber 40 and the excess solvent chamber 90 is also the same as the solvent level in the hopper assembly previously described so that a common and continuous liquid level is maintained in the system.

A vapor pressure equalization line 202 in communication with the chamber 90 insures the pressure is the same between desolventization zone of the rinse chamber 40 and the excess solvent chamber 90. Without this feature, the level control system will not work, if the desolventization area has a pressure which is different from the solvent overflow chamber 90.

The hopper assembly is located at a position low enough that gases are not sucked into the recirculation loop 44 which could break the siphon.

The pressure at the bottom of the rinse chamber is low enough to draw liquid upward at a rate sufficient to provide counter flow washing. The arrangement elements assist in this condition. The intake of the recirculation pump 43 is located below the bottom of the rinse chamber 40. A segment of the recirculation line between the rinse chamber and the hopper assembly is below the bottom of the rinse chamber. Suction on the rinse chamber is produced by a siphon effect by having the suction port of the recirculation pump 43 below the bottom of the rinse chamber.

Figure 5:
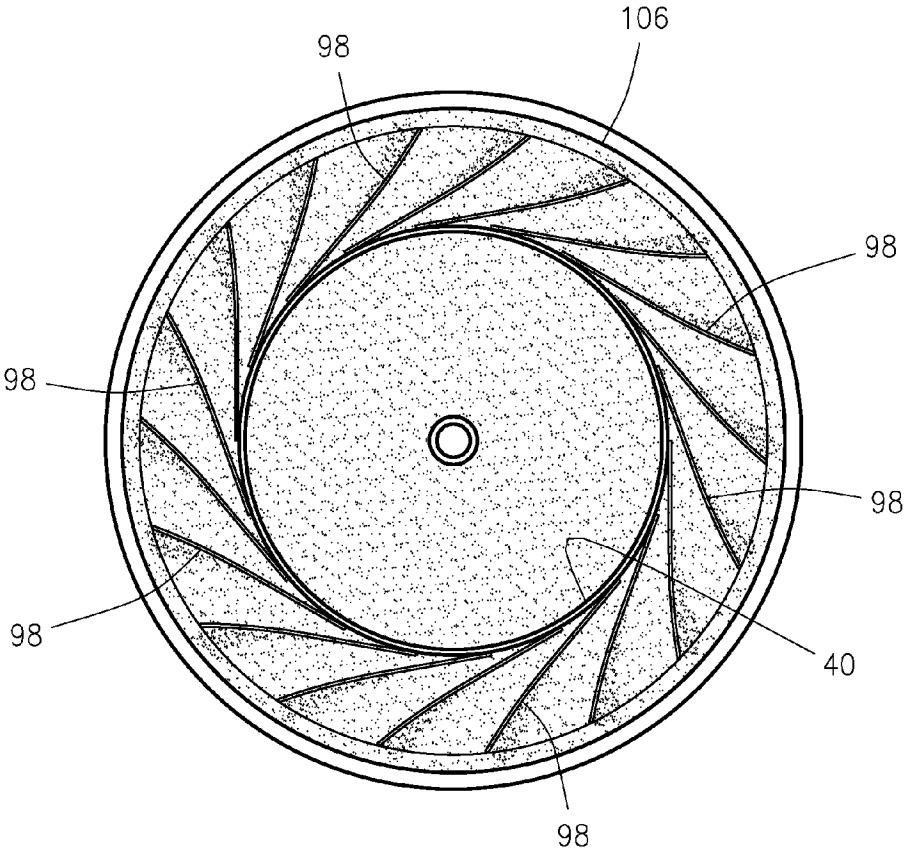
FIG. 5 is a sectional view taken along section line 5-5 of FIG. 3.

The rinse chamber 40 includes an open bottom and a first conical tray spaced from the open bottom wherein the first conical tray 100 has a larger diameter than the chamber. The upper edge of the first conical tray 100 is higher than the open bottom of the rinse chamber 40. FIG. 5 illustrates the first conical tray 106 and a series of upwardly extending plows 98.

Returning to a consideration of the rinse chamber 40, a shaft assembly 100 passes axially through the cylindrical body of the rinse chamber and may include a motor or independently operating motors 102 and 104. In a preferred embodiment, hydraulic motors 102 and 104 are employed at the top of chamber 40. The shaft assembly 100 and motors rotate a first conical tray 106 spaced from the open bottom of the cylindrical body in a first direction. In one non-limiting embodiment, the first conical tray 106 is rotated approximately 10 revolutions per minute (rpm).

The shaft assembly 100 will also rotate a second conical tray 108, which is coaxial with and spaced from the first conical tray, in an opposite direction from rotation of the first conical tray. As best seen in the sectional view in FIG. 3, extending from the second conical tray 108 are series of extending rakes 99. In one preferred embodiment, the shaft assembly 100 includes a shaft within a shaft to rotate the first tray 106 and second tray 108 independently.

The rate of clean sand removal from the rinse chamber 40 is dictated by the plow configuration and the number and movement of the plows relative to the sand. The movement of the plows relative to the sand is achieved by the rotation of the plow or the bowl, which forms the annular P trap.

Downward progression of the sand in the rinse chamber 40 is facilitated by the motion of the rakes 99 relative to the rotating first tray 106. It will be appreciated that either the bowl or the trays may rotate. The rotation of the first tray 106 relative to the rakes 99 tends to lift the solvent saturated sand upward and radially out of the bowl of the first tray 106 above the fluid line 96 so that the sand thereafter moves below the second tray 108 to a conical base. As will be discussed, the sand below the second tray 108 in the conical base is heated directly and indirectly with steam.

Hot steam vapors are applied via an inlet 200 and are circulated therefrom. The heated sand will tend to vaporize the solvent which is drawn off to chamber 122 via a line 116 to a condenser 85. The solvent vapors will be changed to liquid solvents. The clean sand with the solvent removed will fall by gravity to an optional valve 124 with rotating paddles.

Prior art liquid/solid cyclone separators generally remove solids from the bottom of a tank or vessel with a valve or pump. In the present invention, it is desirable to remove solids from the base of the rinse chamber without a valve or pump since these elements are prone to failure through wear or clogging. In addition, it is desirable to expose the drained solids at the bottom of the rinse chamber to hot solvent vapors so that the vapors cause condensation as fresh, pure solvent in order to wash the remaining oil from the sand. Additionally, it is desirable to draw clean solvent through settled solids that accumulate at the bottom of the rinse chamber in a controlled fashion. Moreover, it is desirable to remove sand from the oil/solvent/sand slurry on a continuous basis. Prior art cyclone separators have difficulty performing these functions.

In the present invention, the pressure of the fluid at the bottom of the rinse chamber 40 is low enough to draw or suck liquid up from the bottom of the rinse chamber at a rate to provide sufficient counter flow washing. This is facilitated by the recirculation pump 43. The level of suction or vacuum is determined by the pressure drop in the slurry line between the hopper assembly 12 and the rinse chamber 40.

The present invention permits efficient transportation of sand from the hopper assembly to the rinse chamber and also permits efficient separation of sand from the solvent and oil/sand mixture on a continuous basis.

As best seen in FIGS. 1 and 3, as the valve 124 paddles rotate, the clean sand will exit the rinse chamber as shown by arrow 118 and fall to a cylindrical exit tube 260 having a rotating auger 262 powered by a motor or other device (not shown). Nitrogen combined with heated steam is introduced into the cylindrical exit tube 260 through a port or ports 264 to heat the sand. The heated sand will tend to release any remaining residual solvent or vapors. The heated steam and solvent may be permitted to travel back and be reused in the rinse chamber and may also be removed through an outgoing port 258.

Steam heat may also be directed into an envelope 266 surrounding the cylindrical exit tube 260 to indirectly heat the sand.

The auger mechanism 262 will move the cleaned sand axially out of the cylindrical exit tube 260 to a discharge port 268. The cleaned sand may then be disposed of without environmental concerns.

As an additional, optional feature, oxygen depleted or oxygen free sweep gas may be introduced into the discharge port 268 through a port 270. The oxygen depleted or oxygen free sweep pass is introduced at or near the discharge port 268. The exit tube 260 containing the auger has a pressure equal to or less than the ambient outside pressure. This discourages solvent vapor from escaping with the processed, clean sand. The sweep gas may be generated from exhaust from a motor or engine or from another source. As the action of the auger 262 moves sand out of the tube, sweep gas is drawn into the discharge port 268.

The sweep gas may then be withdrawn from the discharge port 268 and passed through the air cooled condenser (not shown). The exhaust of the sweep gas pump is directed to the incoming tar sand into the hopper assembly which scrubs out the solvent vapor. This feature prevents solvent gas from escaping from the clean sand. The sweep gas reduces solvent lost by displacing the solvent vapor in the steam tube. The sweep gas also allows for lower temperature of the sand exiting the cylindrical exit tube.

The bird feeder style P-trap assists in allowing removal of the rinsed tar sand from the bottom of the rinse chamber 40 in a controlled manner with a minimum amount of solvent associated with the sand. The rinse chamber 40 is arranged such that the liquid level is maintained by a siphon tube arrangement. The siphon is established by introducing a vacuum at the top of the chamber to remove all gases from the upper rinse chamber and siphon tube areas.

The present system will operate as a closed loop process. A key to starting the system up is establishing a siphon. Solvent must be introduced into the bowl of the rinse chamber 40 and the hopper assembly 28 to create a P trap seal which allows the siphon loops to be created. The solvent can be introduced via the recirculation pump loop and the siphon pump loop.

Once the siphons are established, the solvent is supplied through the siphon pump loop.

In the case of the recirculation loop, once a seal is initiated, a vacuum is placed on the rinse chamber 40 to keep the solvent level near the top of the rinse chamber 40. The siphon pump is turned on to insure that the solvent level in the bowl remains relatively constant. This is accomplished by a siphon overflow stand pipe and a flow meter. The pump speed is adjusted such that the standpipe overflow is equal to or greater than zero. The rinse chamber 40 and the recirculation pump loop fill with solvent. Once the recirculation loop and rinse chamber is full of solvent, the siphon loop is established and application of a vacuum is no longer required as long as air does not enter the upper portion of the rinse chamber 40. In that case, a vacuum valve is opened to remove the air trapped in the upper portion of the rinse chamber. Once the siphon loop is established, the recirculation pump may be started. The siphon loop allows the solvent level to remain constant in the rinse chamber even when the solvent recirculation pump is off. This feature also allows for the continuous introduction of tar sands into the hopper assembly 12 without interruption. The tar sand in the hopper assembly is gradually dissolved and transported to the rinse chamber 40 as slurry. The amount of flow through the rinse chamber is modulated to maintain the proper level solvent in the dissolution chamber to prevent the entrainment of air into the recirculation loop and the level solvent from getting too high in the dissolution chamber.

The fresh solvent used to displacement wash sand in the rinse chamber 40 is added around the bottom perimeter of the rinse chamber 40 by an annular ring. The annular ring of solvent is contained by the lower cylindrical wall of the rinse chamber 40 and a tube on the outside of the chamber, which is sealed between the rinse chamber wall and the top of outside tube. This annular ring is also controlled by a siphon tube.

The solvent in the recirculation line 44 moves continuously through the system. An overflow vessel 49 is provided which acts as a surge vessel for liquid 47 and for gas 45 in the surge vessel 49.

The level of sand in the rinse chamber 40 may be monitored by a pair of ultrasonic flow meters 270 and 272. It has been observed that when sand settles, its velocity is zero. Therefore, when an ultrasonic flow meter, such as 272, detects a flow of zero velocity, the sand must have settled above that point. The two sensors 270 and 272 will be utilized to yield a high/low set point.

Figure 6:
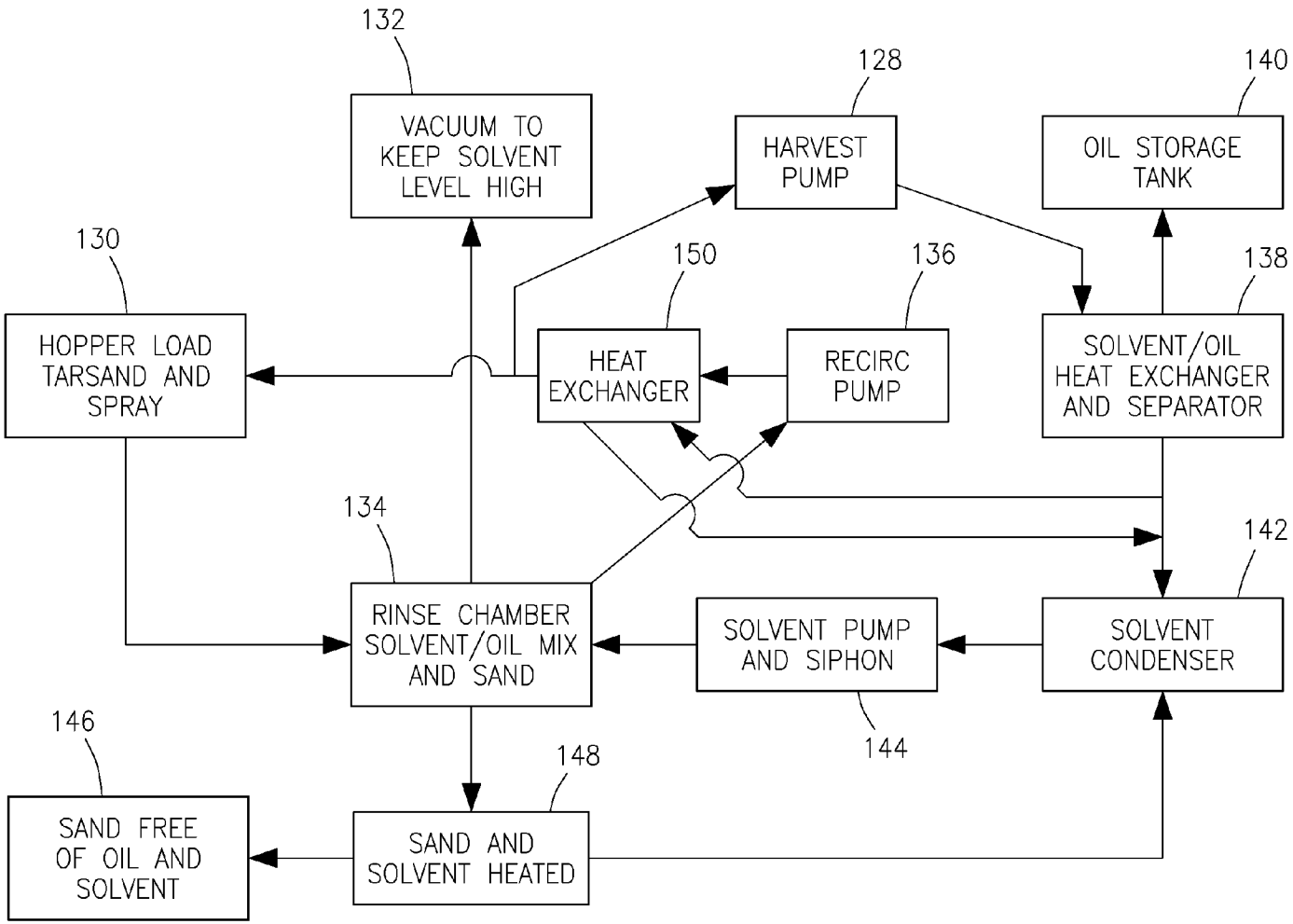
FIG. 6 is a diagrammatic sequential flow chart of the system shown in FIG. 1.

FIG. 6 illustrates a simplified schematic diagram of the procedure to handle and extract hydrocarbons from tar sands. Initially, the hopper assembly 12 is loaded with tar sand and solvent is injected or sprayed onto the incoming tar sand as shown by box 130. Through use of the gas pump 30 and the closed loop system, a vacuum is applied in order to assist in keeping the level of solvent at a desired level as shown at box 132.

Once the recirculation loop, rinse chamber and siphon pump loop are full of solvent, the application of vacuum is no longer required as long as gases to do not enter the upper portion of the rinse chamber or the siphon pump loop in sufficient quantities to break either of these siphons. In this case, a vacuum valve is open to remove the gases trapped in the upper portion of the rinse chamber or the siphon pump loop.

After the solvent contacts the tar sands in the hopper assembly, the slurry of solvent, hydrocarbon liquids, and small sand particles are transported in a slurry to the rinse chamber as shown at box 134. Liquid solvent and hydrocarbon liquid is thereafter drawn off from the rinse chamber by force of the recirculation pump shown at box 136 and directed to the recirculation loop heat exchanger. A portion of the liquid is removed by an oil pump as shown at box 128 and transported to solvent/oil heat exchangers 60 and 62 as shown at box 138. The hydrocarbon oil and bitumen are harvested and delivered to a storage tank 75 as shown at box 140. The solvent, in the form of vapors, are drawn off and condensed as shown at box 142 and also pumped back to the rinse chamber 40 as shown at box 144.

The sand at the base of the rinse chamber is delivered to the steam heating tray or cone where the sand and solvent therein are heated, as shown at box 148. The solvent vapors are delivered back to the solvent condenser 142 while the clean sand which is free of hydrocarbon oil and solvent is removed from the rinse chamber as shown at box 146.

The invention uses the tar sands themselves as the cooling source for condensing the solvent which is vaporized from the clean sand. The heat of condensation is used to heat up the incoming tar sand. This is accomplished by using an oil/solvent recirculation pump. The oil/solvent is pumped through the cooling side of the heat exchanger box 150. The solvent condenses on the heating side of the heat exchanger. The hot oil/solvent mixture is introduced onto the cold tar sand. The heat is transferred to the tar sand. The oil mixture continues through the recirculation loop and eventually returns to the heat exchanger to be reheated. The recirculation loop heat exchanger can maintain a temperature approaching the condensation temperature of the solvent.

In this manner, the majority of energy for heating the tar sands is provided by this heat exchanger loop and a significant portion of the cooling requirement is provided by the heat exchanger. In some cases, the heating requirements for the sand are about the same as the condensation requirements.

An additional benefit of this approach is that the hot oil/solvent mixture increases the dissolution rate of the tar sand regardless of incoming tar sand temperature.

The second aspect of this invention is dissolution, classification, and transport of the tar sand through a continuous process. A considerable amount of expense is normally incurred during the mining, transport, and crushing of tar for processing. In addition, the degree of extraction is a function of the size of the oil bearing sand agglomerates. Traditionally, this is dealt with through the use of a crusher. Crushers are expensive to buy, maintain, and operate. They are prone to jamming and the wear on the crush hammers is extensive. In addition, they are not selective in the crushing process and do not separate the oil bearing sand from the nonporous rock which typically accompany the tar sand. Crushers usually process the tar sand at ambient conditions or with the addition of heat. Cold tar sand is less sticky but harder to crush into small particles. As the particle size requirement falls below one inch the energand cost of operation grows rapidly.

Whereas, the present invention has been described in relation to the drawings attached hereto, it should be understood that other and further modifications, apart from those shown or suggested herein, may be made within the spirit and scope of this invention.

What is claimed is:

1. A method for handling tar sands and extracting bitumen or oil from said tar sands, which method comprises:

depositing tar sands into a hopper assembly with a first input auger;

contacting an organic solvent liquid mixture with said tar sands in said hopper assembly;

dissolving said oil or bitumen in said tar sands with said organic solvent liquid mixture;

allowing sand from said tar sands to separate and fall toward a bottom of said hopper assembly to form a slurry of separated sand and liquid;

transporting said slurry from said hopper assembly to a top of a rinse chamber, said rinse chamber having a cylindrical body and an open bottom enclosed by a first conical tray having a diameter larger than said cylindrical body;

delivering said slurry into a top of said rinse chamber tangentially to cause cyclonic action of the slurry in said rinsing chamber to separate said sands from said liquid;

drawing and removing said solvent and said oil or bitumen mixture from said rinse chamber;

maintaining a continuous and common level of liquid in said hopper assembly, in said first conical tray of said rinse chamber and in an excess solvent chamber;

maintaining less than atmospheric pressure in said rinse chamber by a siphon chamber initiated by a gas pump;

drawing said solvent and said oil/bitumen mixture to a separator to separate said oil/bitumen from said solvent; and returning said solvent to said hopper assembly for reuse to form a closed loop process, wherein said solvent is heated in a heat exchanger prior to said step of contacting with tar sands in said hopper assembly.

2. A method for handling tar sands and extracting bitumen or oil as set forth in claim 1 wherein said hopper assembly has a perforated rotating drum to separate solids below a certain size.

3. A method for handling tar sands and extracting bitumen or oil as set forth in claim 1 including the additional step of separating solids below a certain size in said hopper assembly.

4. A method for handling tar sands and extracting bitumen or oil as set forth in claim 1 wherein said separated sands from said rinsing chamber are heated to remove said solvent.

5. A method for handling tar sands and extracting bitumen or oil as set forth in claim 4, wherein said separated sands are heated by steam heat.

6. A method for handling tar sands and extracting bitumen or oil as set forth in claim 1 wherein said organic solvent is a mixture of hexane and bitumen.

7. A method for handling tar sands and extracting bitumen or oil as set forth in claim 1 including an annular siphon chamber circumnavigating and in fluid communication with said rinse chamber.

8. A method for handling tar sands and extracting bitumen or oil as set forth in claim 1 wherein said excess solvent chamber has a closed outer container and an open top inner container.

9. A method for handling tar sands and extracting bitumen or oil as set forth in claim 1 including the additional step of extracting sand from said rinse chamber through a valve to an exit cylinder; and heating said exist cylinder to drive off solvent vapors.

10. A method for handling tar sands and extracting bitumen or oil as set forth in claim 1 including the additional step of rotating said first conical tray to move said sand out of said tray.

* * * * *